US009309753B2

(12) United States Patent
Noble et al.

(10) Patent No.: US 9,309,753 B2
(45) Date of Patent: Apr. 12, 2016

(54) HIGH-SPEED ROD-DRIVEN DOWNHOLE PUMP

(71) Applicant: Weatherford/Lamb Inc., Houston, TX (US)

(72) Inventors: Evan Noble, Edmonton (CA); Eduardo Perdomini Lara, Porto Alegre (BR)

(73) Assignee: Weatherford Technology Holdings, LLC, Houston, TX (US)

( * ) Notice: Subject to any disclaimer, the term of this patent is extended or adjusted under 35 U.S.C. 154(b) by 440 days.

(21) Appl. No.: 13/827,624

(22) Filed: Mar. 14, 2013

(65) Prior Publication Data

US 2014/0262317 A1 Sep. 18, 2014

(51) Int. Cl.
*E21B 43/12* (2006.01)

(52) U.S. Cl.
CPC ..... *E21B 43/126* (2013.01)

(58) Field of Classification Search
CPC ..... E21B 43/126; E21B 47/0006; E21B 47/0007; E21B 17/00; E21B 19/00
See application file for complete search history.

(56) References Cited

U.S. PATENT DOCUMENTS 5,015,162 A * 5/1991 Heppner ..... 418/48
5,143,153 A 9/1992 Bach et al.
5,567,138 A 10/1996 Newton
2008/0060819 A1* 3/2008 Blaquiere ..... 166/381
2009/0032242 A1* 2/2009 Zupanick ..... 166/78.1
2010/0098563 A1* 4/2010 Liu et al. ..... 417/410.3
2012/0237380 A1* 9/2012 Robles-Villa ..... 418/48

OTHER PUBLICATIONS

Patent Examination Report No. 1 received in counterpart Austrailian Appl. 2014201348, dated May 1, 2015.

First Office Action received in counterpart Canadian Appl. 2,845,338, dated Jul. 16, 2015.

* cited by examiner

*Primary Examiner* — Brad Harcourt
(74) *Attorney, Agent, or Firm* — Blank Rome, LLP

(57) ABSTRACT

A surface drivehead drives a downhole pump by rotating a rod string at the surface. The downhole pump can be connected downhole to the rod string via a downhole latching mechanism. The surface drivehead has an assembly that can move the rod string upwards or downwards along an axis to either increase or decrease rod string tension. During rod string rotation, rod tension is monitored. If rod string tension changes during rotation, the surface drivehead can automatically compensate by moving the rod string upwards or downwards along the axis to either recapture or eliminate tension. In this way, the surface drivehead can maintain a substantially constant rod string tension to drive the downhole pump at high speeds.

33 Claims, 9 Drawing Sheets

HIGH-SPEED ROD-DRIVEN DOWNHOLE PUMP

BACKGROUND

The present application is directed to systems and methods for rotating a rod string from the surface at substantially high speeds. It is also directed to rotating a rod string from the surface at substantially high speeds to drive a downhole pump.

One of skill in the art appreciates that pumps are used to extract fluids, such as crude oil or water, from a producing well. Often times this extraction process requires artificial lift, which can be carried out using a variety of known pumps, including but not limited to pump jacks, hydraulic pumping systems, progressing cavity pumps (PCPs), or electric submersible pumps (ESPs).

PCPs transfer target fluids to the surface via rotation of a helical rotor against a stationary metal/rubber stator. Rotation of the rotor causes fix sized fluid containing cavities to move, thereby displacing the fluid to the surface. The rotor is driven by a rod string rotated by a surface rotary drive.

A major advantage of the PCP design is that its motor components are positioned on the surface and safe from downhole well conditions. But PCPs also have significant drawbacks. In deep wells, they are driven from the surface through an often substantially long rod string. It is difficult to safely rotate a long rod string at high speeds. The higher the rotation speed, the easier it is to lose rod string stability and create dangerous rod string whip. Thus, most PCPs are driven from the surface at speeds below 500 rpms. In addition, downhole PCP components such as the elastomer and elastomer/metal bond can degrade in certain well conditions (e.g, light oils, hot temperatures, etc.).

The pump component of an ESP is a multistage centrifugal pump. The pump is driven by a sealed motor positioned downhole below the pump. The downhole motor is connected to a variable speed controller at the surface via an electrical cable. The motor rotates the ESPs impellers at substantially high speeds creating a centrifugal force that pushes the target fluids upwards to the surface.

Like PCPs, ESPs also have drawbacks. Many of the subsurface components, including the motor, cable, and seals, are submerged in the well. Thus, these components are directly exposed to the well's hostile conditions. This exposure shortens the life of and often damages or ruins the components, requiring expensive and time consuming replacements.

There is currently no practical solution for safely rotating a rod string at high speeds to improve a surface-driven rod system's production rate. There are also only limited solutions for maintaining the integrity of ESP components in a well. But both surface-driven rod systems and ESPs provide significant advantages. Thus, there is need in the art for systems and methods that improve upon the advantages of these systems, but at the same time eliminate their disadvantages. In other words, there is need in the art for systems and methods that are designed to move sensitive and expensive equipment from downhole to the surface where they are safe from exposure to harsh well conditions.

SUMMARY

A surface drivehead can be used to rotate a rod string at the surface. In one arrangement, the surface drivehead can include a polished rod engaged with a drivehead motor. The polished rod can be connected to a rod string so that as the polished rod is rotated by the drivehead motor, rotational power is transferred from the surface drivehead to the rod string. The polished rod can be further coupled to an assembly. The assembly can move the polished rod upwards or downwards along an axis, thereby increasing and decreasing tension on the connected rod string.

In a broad aspect, the surface drivehead can maintain a substantially constant rod string tension during high speed rod string rotation. For example, the surface drivehead can monitor tension during rotation. If the tension changes unexpectedly, the surface drivehead can move the top end of the rod string along the axis via the assembly and polished rod to increase or decrease rod string tension as needed.

In another broad aspect, a surface drivehead can drive a downhole pump by rotating a rod string at the surface. The downhole pump can include a multistage centrifugal pump. In one arrangement, the downhole pump and rod string can be connected via a downhole latching mechanism.

The foregoing summary is not intended to summarize each potential embodiment or every aspect of the present disclosure.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the invention is not limited to the precise arrangements and instrumentalities shown.

DETAILED DESCRIPTION

Figure 1:
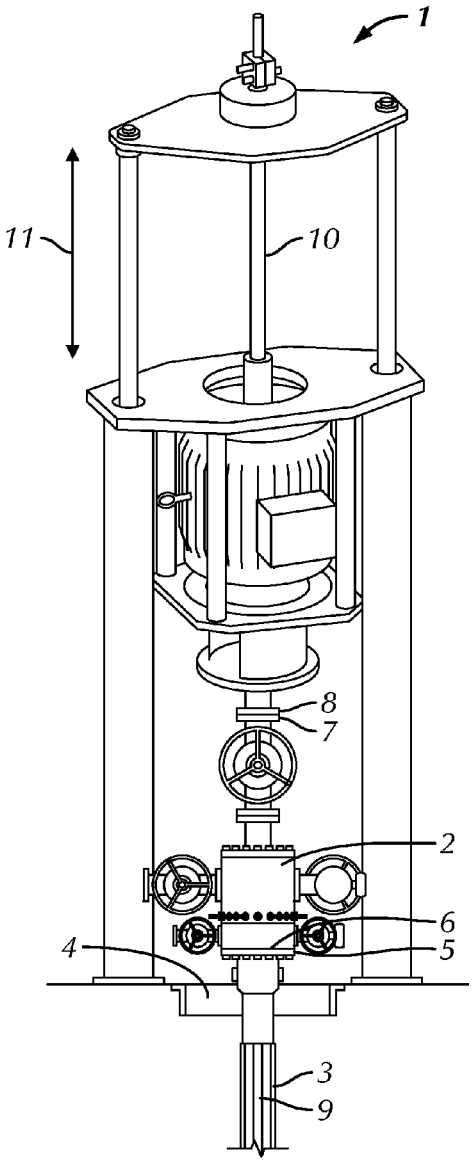
FIG. 1 illustrates an embodiment of a well assembly.

Before explaining at least one embodiment in detail, it is understood that the invention set forth herein is not limited in its application to the construction details or component arrangements set forth in the following description or illustrated in the drawings. The invention is capable of other embodiments and being practiced and carried out in various ways. Also, it is understood that the phraseology and terminology employed herein are merely for descriptive purposes and should not be regarded as limiting. It should be understood that anyone of the features described herein may be used separately or in combination with other features. Other systems, methods, features, and advantages will be or become apparent to one with skill in the art upon examination of the drawings and the detailed description herein. It is intended that all such additional systems, methods, features, and advantages be included within this description and be protected by the accompanying claims.

The present application is directed to systems and methods for improving the production rate and integrity of well pump systems, especially in hostile well conditions. In one embodiment, a surface drivehead is designed to rotate a rod string and maintain a substantially constant rod string tension. By maintaining the rod string tension the rod string can be rotated at substantially high speeds. In another embodiment, a downhole pump is operated through a surface-driven rod string. In yet another embodiment, the rod string is connected to a downhole pump via a downhole latching mechanism. With these embodiments, which are explained in detail below, a well can be produced at relatively high speeds while sensitive system components are kept safe from downhole well conditions.

D. Surface Drivehead

Embodiments of the surface drivehead are illustrated, by way of example only, in FIGS. 1-4. All of these embodiments operate on the same principle—to maintain a substantially constant tension on a rotating rod string. In one embodiment, a substantially constant rod string tension is approximately 4,000 lbs-20,000 lbs. For example, during rod string rotation, there may be unwanted increases and decreases in rod string tension as rod string length fluctuates due to thermal expansion or changing pump conditions. The surface driveheads disclosed herein can compensate for these tension changes by moving the rod string upwards or downwards to increase or decrease tension in the rod string as needed. These systems and methods are described in further detail below.

FIG. 1 shows the surface components of a conventional well assembly, comprising an embodiment of a surface drivehead 1, a wellhead 2, and a production tubing 3. The surface drivehead 1 can be of any type, including but not limited to all of the surface driveheads described in this application. The production tubing 3 is suspended in the wellbore 4 by a connection between the upper end 5 of the production tubing 3 and the lower end 6 of the wellbore 4. The upper end 7 of the wellhead 4 is coupled to the surface drivehead 1 via the drivehead's stuffing box 8. Connections between the production tubing 3, wellhead 4, and surface drivehead 1 can be of any type, including but not limited to a bolt assembly or swage and collar assembly.

A rod string 9 is positioned within the production tubing 3 and extends downwardly into the wellbore 4. The rod string 9 may be of any type, such as but not limited to a continuous sucker rod or a standard jointed sucker rod. The rod string's 9 upper end is connected below the stuffing box 8 to a polished rod 10, which effectively connects the rod string 9 to the surface drivehead 1. The surface drivehead 1 rotates the polished rod 10 to transfer rotational power to the rod string 9. Furthermore, the surface drivehead 1 can move the polished rod upwards or downwards along an axis 11 to move the top end of the rod string 9 upwards or downwards. In one embodiment, the rod string 9 transfers torque to a downhole pump connected to the lower end of the rod string 9.

Figure 2A:
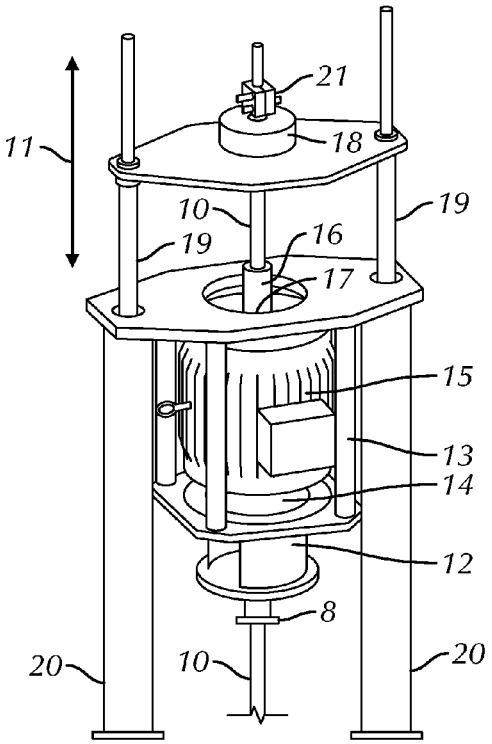
FIGS. 2A-2C illustrate various orientations of an embodiment of a first surface drivehead.

FIG. 2A illustrates a first embodiment of a surface drivehead 1. A polished rod 10 passes through a stuffing box 8. The stuffing box 8 seals around the polished rod 10 to prevent the escape of target fluid from production tubing as the polished rod 10 rotates and moves along and about the axis 11.

Above the stuffing box 8, the polished rod 10 passes through a drivehead support 12 that supports the weight of the surface drivehead 1 components. A motor cage 13 rests on top of the drivehead support 12 and includes a motor base 14 for supporting the drivehead motor 15. The drivehead motor 15 rests on the motor base 14 and is enclosed within and supported by the motor cage 13. The drivehead motor 15 can be any type, including but not limited to an electric or hydraulic motor.

The polished rod 10 passes through a slipping joint 16 that extends through and is engaged with a hollow shaft 17 within the drivehead motor 15. In one embodiment, the slipping joint 16 and upper end of the polished rod 10 are splined to facilitate polished rod 10 rotation. For example, when the drivehead motor 15 is in use, the motor's hollow shaft 17 turns the slipping joint 16, which catches and thus turns the splined end of the polished rod 10.

Figure 2B:
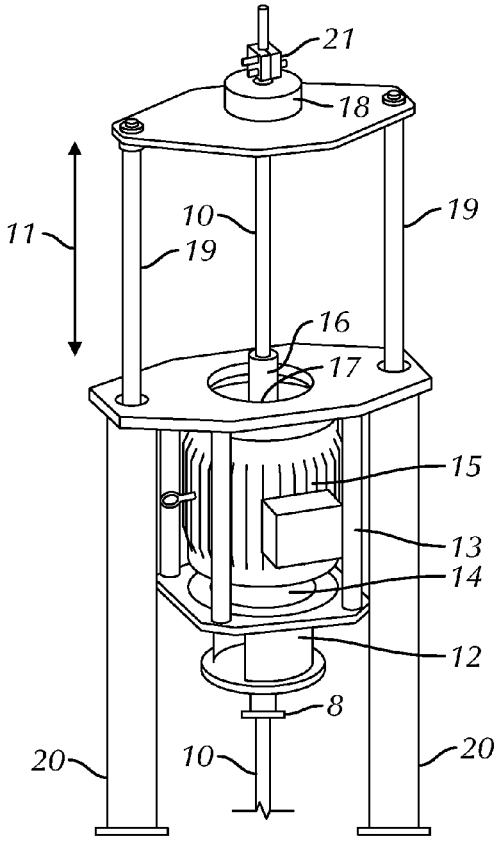
Figure 2C:
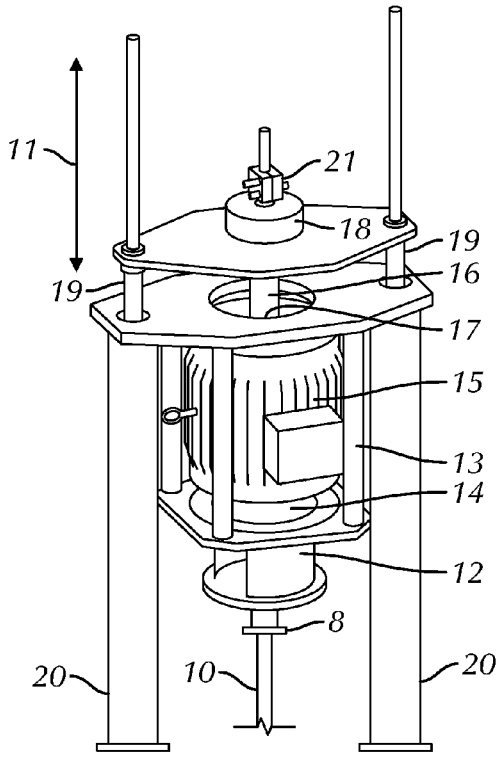

Above the slipping joint 16, the polished rod 10 passes through an assembly 18. The assembly may be any mechanism that can be actuated to move the polished rod 10 along the axis 11. In one embodiment, the assembly is an axial bearing 18. The axial bearing may be coupled to one or more linear actuators, which can be any device capable of actuating an assembly to move the polished rod 10 along the axis 11. In an embodiment, the axial bearing 18 is coupled to one or more cylinder rods 19, which are a component of the one or more hydraulic cylinders 20. The one or more hydraulic cylinders 20 may be fixed to a surface and provide stability to the surface drivehead 1. By activating the hydraulic cylinders 20, the axial bearing 18 is capable of traveling along the axis 11 by sliding up and down the one or more cylinder rods 19. Above the axial bearing 18, the polished rod 10 is held to the axial bearing 18 by a clamp 21. Thus, as the axial bearing 18 slides up or down the cylinder rods 19 it forces the polished rod to move along the axis 11. By way of example only, FIG. 2B illustrates a position of the axial bearing 18 and polished rod 10 following an upward axial bearing 18 movement. FIG. 2C illustrates a position of the axial bearing 18 and polished rod 10 following a downward axial bearing 18 movement.

Figure 3A:
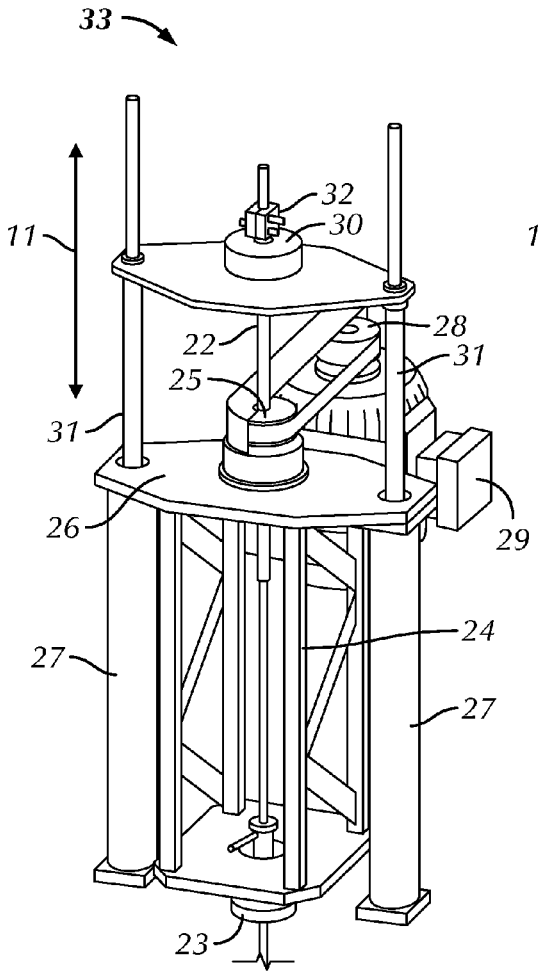
FIGS. 3A-3C illustrate various orientations of an embodiment of a second surface drivehead.

FIG. 3A illustrates a second embodiment of a surface drivehead 33. A polished rod 22 passes through a stuffing box 23. The stuffing box 23 seals around the polished rod 22 to prevent the escape of target fluid from a production tubing as the polished rod 22 moves along and about the axis 11.

A motor support 24 rests on top of the stuffing box 23. The motor support 24 is designed to hold a drivehead motor 25 exterior to the main body of the surface drivehead 34. Above the stuffing box 23, the polished rod 24 passes through the motor support 24 and into a slipping joint 25, which rests on a base 26. The base 26 is fixed to the main tubing of one or more hydraulic cylinders 27. A gear belt 28 connects the slipping joint 25 to a drivehead motor 29. In one embodiment, the drivehead motor 29 uses synchronous sheaves or belts in a 1:1 ratio. In another embodiment, a gear box connects the slipping joint 25 to the drivehead motor 29. The drivehead motor 29 can be any type, including but not limited to an electric or hydraulic motor.

In one embodiment, the slipping joint 25 and upper end of the polished rod 22 are splined to facilitate polished rod 22 rotation. For example, when the drivehead motor 29 is in use, the motor's gear belt 28 turns the slipping joint 25, which catches and turns the splined end of the polished rod 22.

Figure 3B:
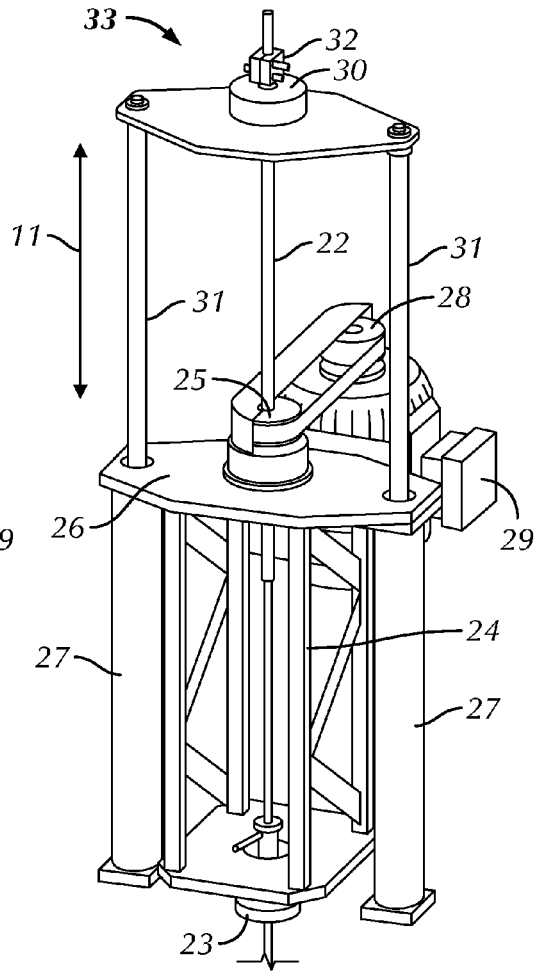
Figure 3C:
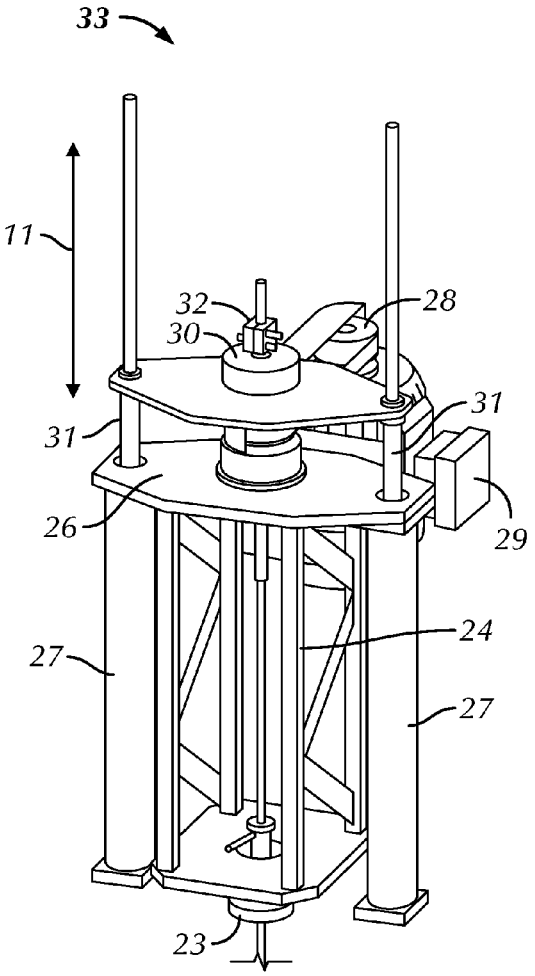

Above the slipping joint 25, the polished rod 22 passes through an axial bearing 30. The axial bearing 30 is coupled to one or more cylinder rods 31, which are a component of the one or more hydraulic cylinders 27. The one or more hydraulic cylinders 27 may be fixed to a surface and provide stability to the surface drivehead 33. By activating the hydraulic cylinders 27, the axial bearing 30 is capable of traveling along the axis 11 by sliding up and down the one or more cylinder rods 31. Above the axial bearing 30, the polished rod 22 is held to the axial bearing 30 by a clamp 32. Thus, as the axial bearing 30 slides up or down the cylinder rods 31 it forces the polished rod 22 to move along the axis 11. By way of example only, FIG. 3B illustrates a position of the axial bearing 30 and polished rod 22 following an upward axial bearing 30 movement. FIG. 3C illustrates a position of the axial bearing 30 and polished rod 22 following a downward axial bearing 30 movement.

Figure 4A:
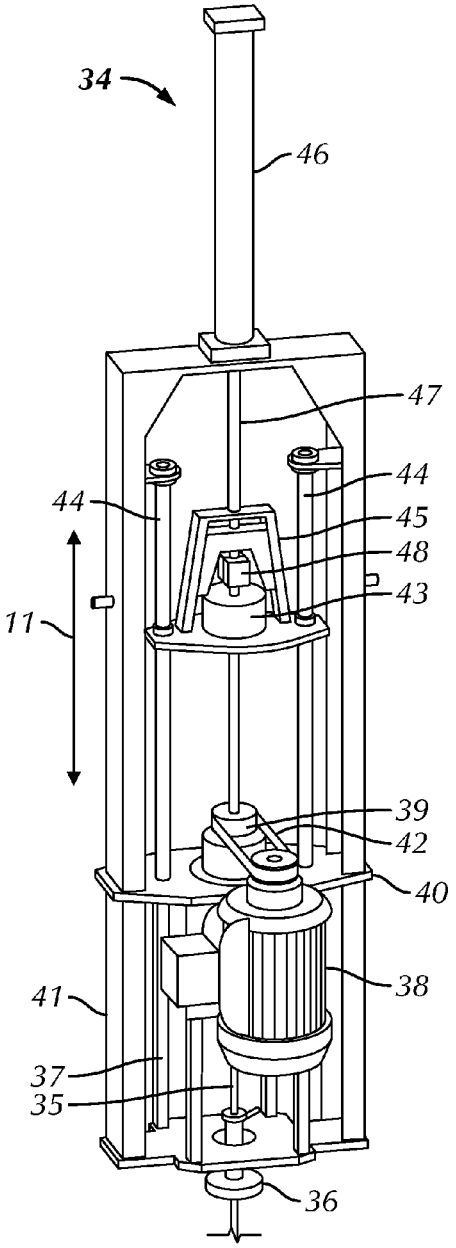
FIGS. 4A-4C illustrate various orientations of an embodiment of a third surface drivehead.

FIG. 4A illustrates a third embodiment of a surface drivehead 34. A polished rod 35 passes through a stuffing box 36. The stuffing box 36 seals around the polished rod 35 to prevent the escape of target fluid from a production tubing as the polished rod 35 moves along and about the axis 11.

A motor support 37 rests on top of the stuffing box 36. The motor support 37 is designed to hold a drivehead motor 38 exterior to the main body of the surface drivehead 34. Above the stuffing box 36, the polished rod 35 passes through the motor support 37 and into a slipping joint 39, which rests on a base 40. The base 40 and motor support 37 are connected to a drivehead frame 41, which can be attached to a surface and provides stability to the surface drivehead 34. A gear belt 42 connects the slipping joint 39 to the drivehead motor 38. In one embodiment, the drivehead motor 38 uses synchronous sheaves or belts in a 1:1 ratio. In another embodiment, a gear box connects the slipping joint 25 to the drivehead motor 29. The drivehead motor 38 can be any type, including but not limited to an electric or hydraulic motor.

In one embodiment, the slipping joint 39 and upper end of the polished rod 35 are splined to facilitate polished rod 35 rotation. For example, when the drivehead motor 38 is in use, the motor's gear belt 42 turns the slipping joint 39, which catches and turns the splined end of the polished rod 35.

Figure 4B:
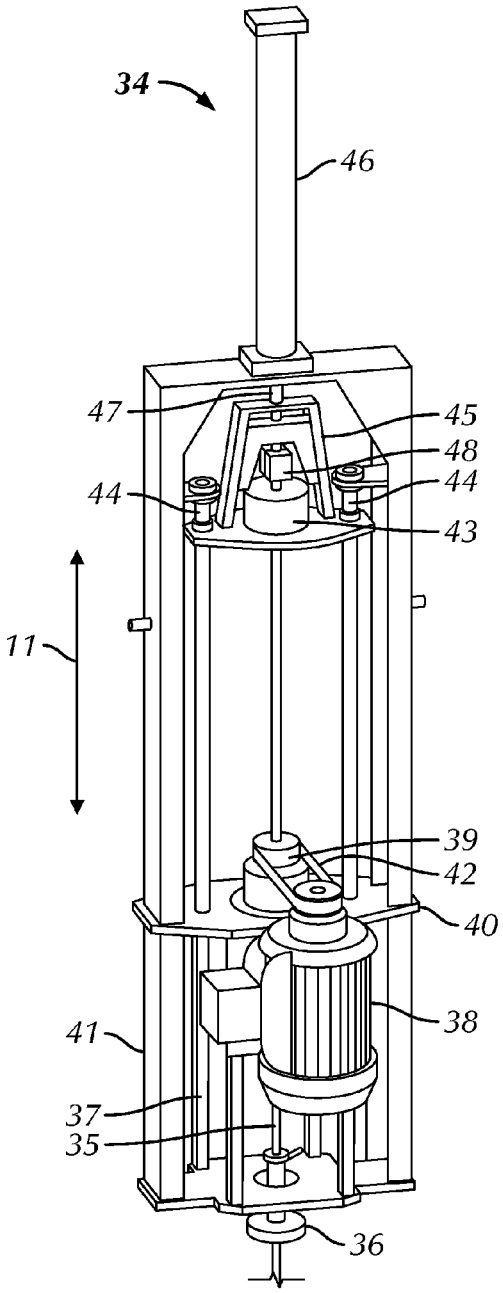
Figure 4C:
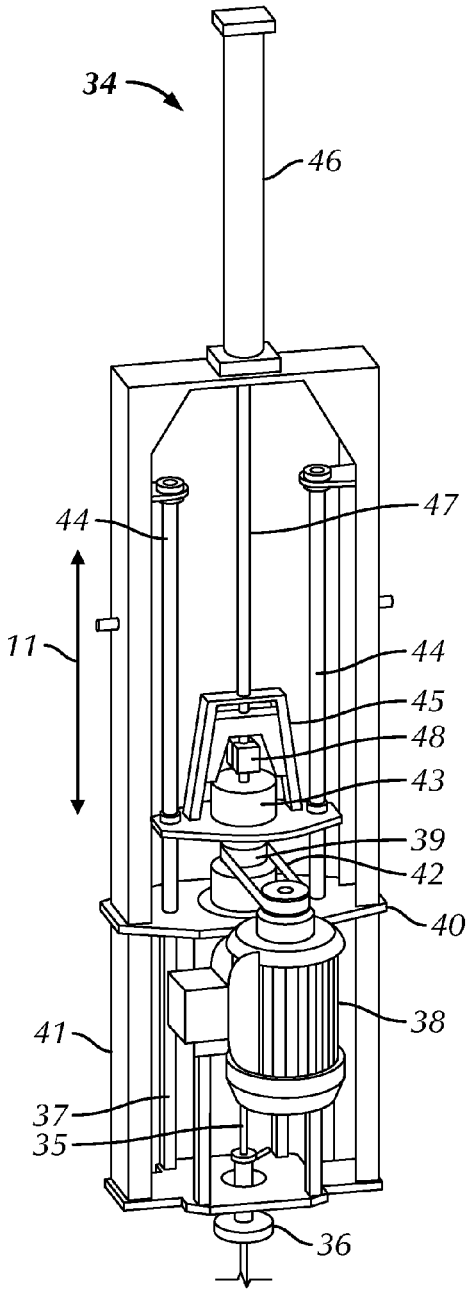

Above the slipping joint 39, the polished rod 35 passes through an axial bearing 43. The axial bearing 43 is coupled to one or more stabilization rods 44, which are supported by the base 40. The axial bearing 43 is also coupled to a stabilization flange 45, which is a component of the hydraulic cylinder 46. By activating the hydraulic cylinder 46, a cylinder rod 47 is able to move the stabilization flange 45 upwards and downwards, thereby moving the axial bearing 43 upwards and downwards along the stabilization rods 44. Above the axial bearing 44, the polished rod 35 is held to the axial bearing 44 by a clamp 48. Thus, as the axial bearing 44 slides up or down the stabilization rods 44 it forces the polished rod 35 to move along the axis 11. By way of example only, FIG. 4B illustrates a position of the axial bearing 44 and polished rod 35 following an upward axial bearing 44 movement. FIG. 4C illustrates a position of the axial bearing 44 and polished rod 35 following a downward axial bearing 44 movement.

In one embodiment, the hydraulic cylinders 20, 27, 46 are activated by hydraulic fluid power from a hydraulic power pack. In yet another embodiment, the hydraulic cylinders 20, 27, 46 use flow line pressure and a regulating valve to maintain a set pressure, which would exert the desired tension when applied to a prescribed area.

In further embodiments, in lieu of hydraulic cylinders 20, 27, 46, the polished rod 10, 22, is moved along the axis 11 by one or more linear actuators configured to displace a rod string along its longitudinal axis, including but not limited to hydraulic cylinders, mechanical springs, ball screws, or a crane system. The design of the linear actuators is not critical to the application's purpose, and any linear actuator capable of moving the polished rod 10, 22, 35 along the axis 11 would be sufficient to meet the application's purpose.

In still another embodiment, the one or more linear actuators can move the entire surface drivehead 1 or one or more components of the surface drivehead 1 (e.g., polished rod 10, 22, 35, axial bearing 18, 30, 43, clamp 21, 32, 48, drivehead motor 38, etc.) upwards or downwards along the axis 11. By moving the entire surface drivehead 1 or one or more components of the surface drivehead 1 the attached rod string is also displaced along the axis 11.

In yet another embodiment, the axial bearing 18, 30, 43 and polished rod 10, 22, 35 are moved along the axis 11 to ensure proper space out of a PCP rotor, or to move the top end of the rod string 9 up or down by a small amount to move the location of tubing wear.

Figure 5:
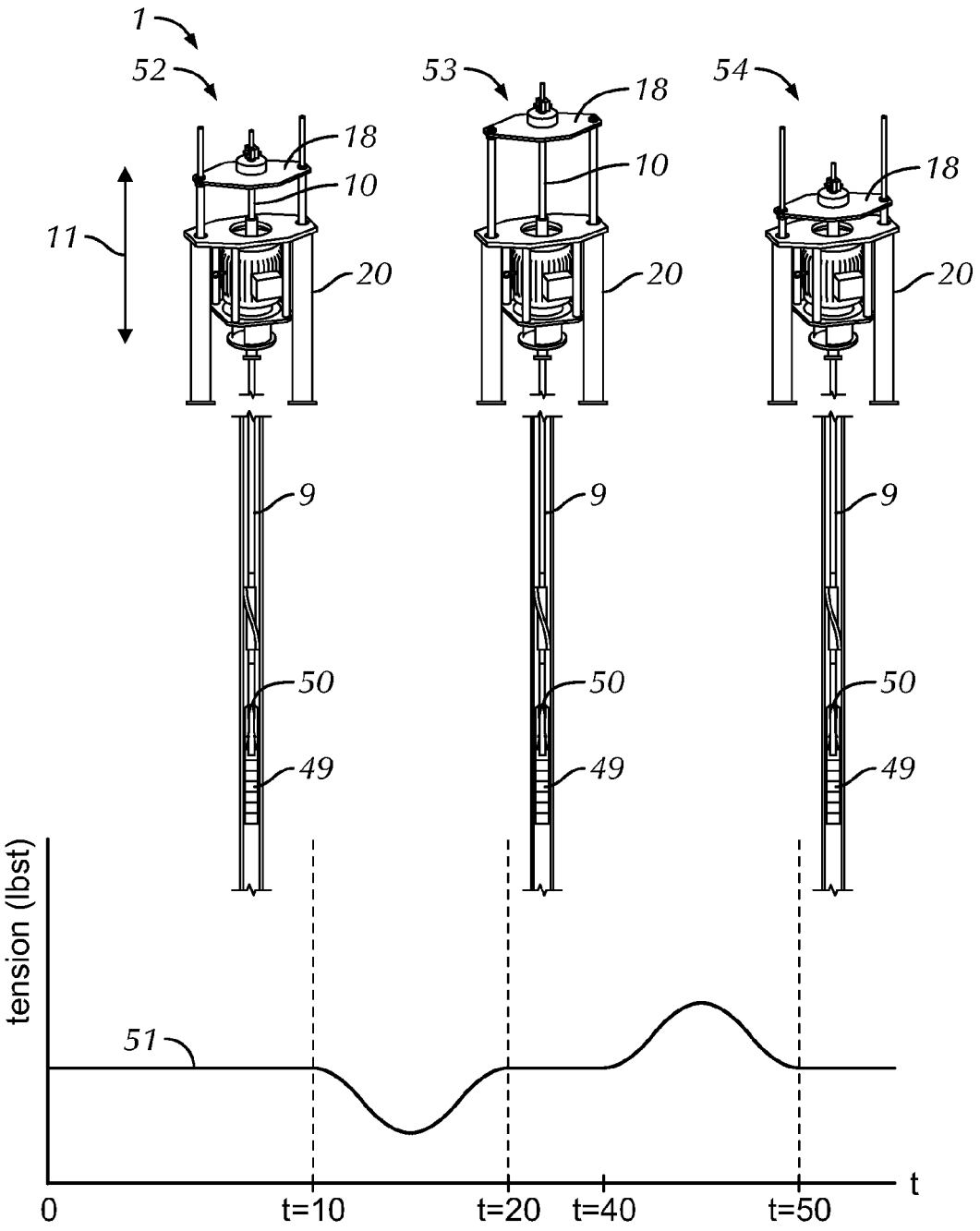
FIG. 5 illustrates maintaining a substantially constant rod string tension during rod string rotation.

It is desirable to rotate a rod string at high speeds to increase production rate. But in order to do so, a constant tension must be substantially maintained to reduce the probability of dangerous rod whip. FIG. 5 demonstrates maintaining a substantially constant rod string tension using one embodiment of a surface drivehead. It is understood that the surface driveheads illustrated in FIG. 5 can be substituted for any of the alternative embodiments disclosed herein.

The surface drivehead 1 is connected to a rod string 9 via a polished rod 10. The drivehead 1 rotates the polished rod 10 at a predetermined speed to transfer rotational power to the rod string 9. In one embodiment, this rotation power is transferred from the rod string 9 to a downhole pump 49, coupled to the bottom end 50 of the rod string 9. The downhole pump 49 can be any type, including but not limited to a PCP, or any type of submersible pump, such as a multistage centrifugal submersible pump. Furthermore, the rod string 9 can be any type, including continuous sucker rod or standard jointed rod.

The rod string 9 is placed at a predetermined tension 51 during rotation to eliminate or significantly reduce vibrations or instabilities associated with a long, unsupported rod string 9 spinning at substantially high speeds. This predetermined tension 51 is calculated based on well surveys, rod string dimensions, and target rotation speeds. For example, the amount of tension required for stability depends on the cross section area/diameter of the rod used. In one embodiment, a ¾" diameter may rod require approximately 7,500 lbs tension force to remain stable during rotation at speeds between approximately 1200-1500 rpms. In another embodiment, a ⅞" diameter rod may require approximately 10,000 lbs tension force to remain stable during rotation at speeds between approximately 1200-1500 rpms. In another embodiment, a 1" diameter rod may require approximately 13,500 lbs tension force to remain stable during rotation at speeds between approximately 1200-1500 rpms. In another embodiment, the predetermined tension may be between approximately 7,500-15,000 lbs tension force.

As the rod string 9 is rotated its dimensions may change in the well due to thermal expansion, which can result in undesirable tension changes. The surface drivehead compensates for these changes by moving the rod string 9 upwards or downwards to increase or decrease tension on the rod string 9. For example, referring to FIG. 5, by way of example only, at t=0, the rod string is rotated at the predetermined tension 51. The axial bearing 18 and polished rod 10 are at a first position 52 to achieve the predetermined tension 51.

At time t=10, the rod string 9 length begins to increase due to thermal expansion, thereby decreasing the tension on the rod string 9. To compensate for this tension decrease, one or more hydraulic cylinders 20 move the axial bearing 18 and polished rod 10 upwards along the axis 11. This upward movement pulls the top end of the rod string 9 upwards, thereby substantially recapturing the rod string's 9 lost tension at t=20. At t=20 the axial bearing 18 and polished rod 10 are at a second position 53, which is above the first position 52.

At t=40 the rod string 9 length decreases, thereby increasing the tension on the rod string 9. To compensate for this tension increase, the one or more hydraulic cylinders 20 move the axial bearing 18 and polished rod 10 downwards along the axis. This downward movement pushes the top end of the rod string 9 downwards, thereby substantially releasing the rod string's 9 gained tension at t=50. At t=50 the axial bearing 18 and polished rod 10 are at a third position 54, which is below the first position 52.

The surface drivehead 1 can maintain a substantially constant tension during rod string 9 rotation. Therefore, the risk of rod whip is substantially reduced and the surface drivehead 1 can safely rotate the rod string 9 at substantially high speeds. Furthermore, the rod string 9 is rotated at substantially high speeds with negligible vibration and noise. In one embodiment, the rod string 9 is rotated at speeds between approximately 0-3600 rpms. In another embodiment, the rod string 9 is rotated at substantially high speeds to drive a downhole pump 49. The downhole pump 49 can be a PCP, or any type of submersible pump, including a multistage centrifugal downhole pump. In one embodiment, a submersible pump is rotated at high speeds and can produce between approximately 200 to 1000 $m^3$/day from between approximately 300 to 3000 m depth.

In one embodiment, the tension acting on the rod string may be measured and monitored in real time using an inline axial load cell mounted on the surface drivehead 1. The surface drivehead 1 may include software to monitor the load cell, which can detect the onset of rod instability as rod string tension fluctuates.

In another embodiment, the surface drivehead 1 can respond to changes in rod string 9 tension by automatically activating the hydraulic cylinders 20 to move the top end of the rod string 9 in the necessary direction and distance along the axis 11 to compensate for the changes. In another embodiment, an operator can monitor changes in rod string 9 tension and remotely activate the hydraulic cylinders 20 to move the top end of the rod string 9 in the necessary direction and distance along the axis 11 to compensate for the changes.

In another embodiment, the rod string 9 is pulled by the surface drivehead 1 to substantially high tensions. The tension is then reduced over time by a reasonable amount until the rod string 6 reaches a predetermined operating tension 51.

E. Rod-Driven Downhole Pump

Figure 6:
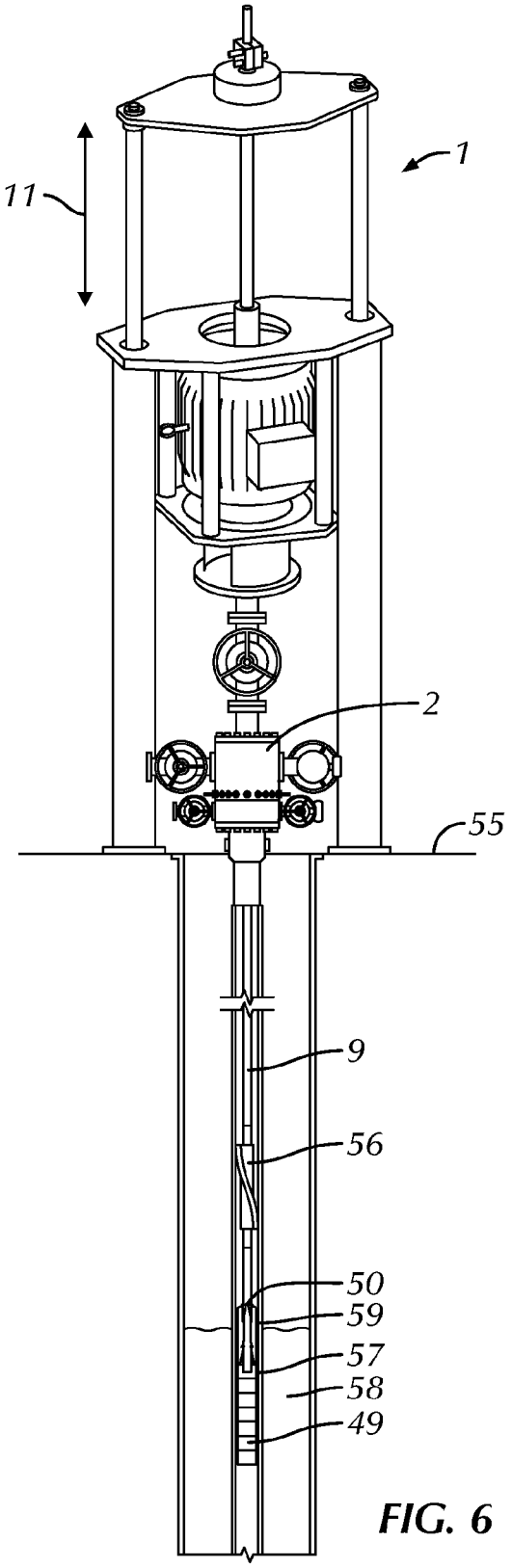
FIG. 6 illustrates an embodiment of a rod-driven submersible pump.

An embodiment of a rod-driven downhole pump is illustrated, by way of example only, in FIG. 6. The system primarily comprises a surface drivehead 1, a rod string 9, and a downhole pump 49. The surface drivehead 1 may be any type, including but not limited to a conventional surface drive, or one of the surface driveheads described herein.

The surface drivehead 1 rotates the rod string 9 at the surface 55 via a polished rod 10, which passes through a wellhead 2 to connect with the rod string 9. The rod string 9 extends downwardly into the wellbore and may comprise a plurality of rods interconnected by rod couplings 56. The rod string 9 may be continuous sucker rod or a standard jointed rod.

The bottom 50 of the rod string 9 is coupled to the upper end 57 of the downhole pump 49. The downhole pump 49 can be any type of downhole pump, including but not limited to a PCP, or any type of submersible the pump, including a multistage centrifugal downhole pump. In one embodiment, the downhole pump 9 is a multistage centrifugal pump.

In one embodiment, in operation, the downhole pump 49 is submerged in a target fluid 58. The surface drivehead rotates the polished rod 10, which transfers rotational power to the connected rod string 9. Rotating the rod string 9 at the surface transfers rotational power to the bottom 50 of the rod string 9, thereby transferring rotational power to the attached downhole pump 49. That rotational power drives the downhole pump 49 to push target fluids 58 to the surface.

In another embodiment, the downhole pump 49 is a multistage centrifugal pump. The bottom 50 of the rod string 9 is coupled to the centrifugal pump's bearing assembly. When rotational power is transferred from the rod string 9 to the bearing assembly, the pump's impellers rotate creating a substantial centrifugal force. That force pushes target fluids 58 to the wellhead 2.

In yet another embodiment, the rod string 9 and downhole pump 49 are coupled via a downhole latching mechanism 59. The downhole latching mechanism can be of any type, including all those described herein. In this embodiment, rotational power is transferred from the bottom 50 of the rod string 9 to the downhole latching mechanism 59, and from the downhole latching mechanism 59 to the downhole pump 49.

In another embodiment, the surface drivehead 1 is one of the surface driveheads 1 described herein. The surface drivehead 1 transfers rotational power from the drivehead 1 to the bottom 50 of the rod string 9, and from the bottom 50 of the rod string 9 to the downhole pump 49. The surface drivehead 1 rotates the rod string 9 at speeds between approximately 0-3600 rpms. The surface drivehead 1 can maintain a substantially constant tension on the rod string 9 by moving the rod string upwards or downwards along an axis 11 to compensate for rod string tension increases and decreases. The rod string 9 and downhole pump 9 may be connected via a downhole latching mechanism 59, such as those described herein. Furthermore, the downhole pump 9 may be a PCP, or a submersible pump, such as a multistage centrifugal downhole pump.

F. Downhole Latching Mechanism

Figure 7A:
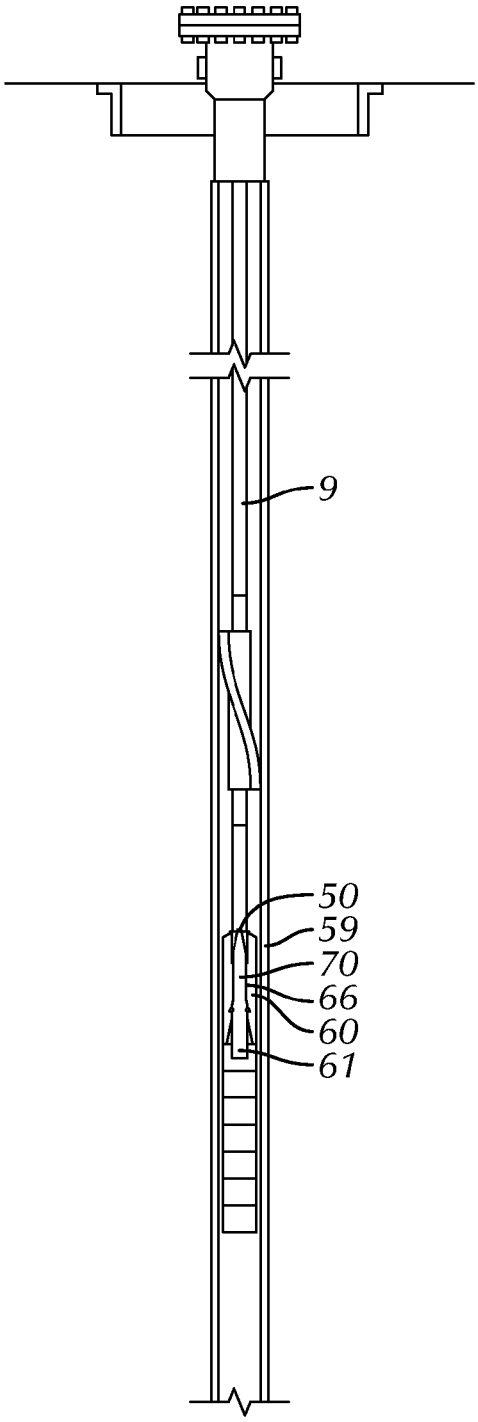
FIG. 7A-7B illustrate cross sectional views of embodiments of a downhole latching mechanism.
Figure 7B:
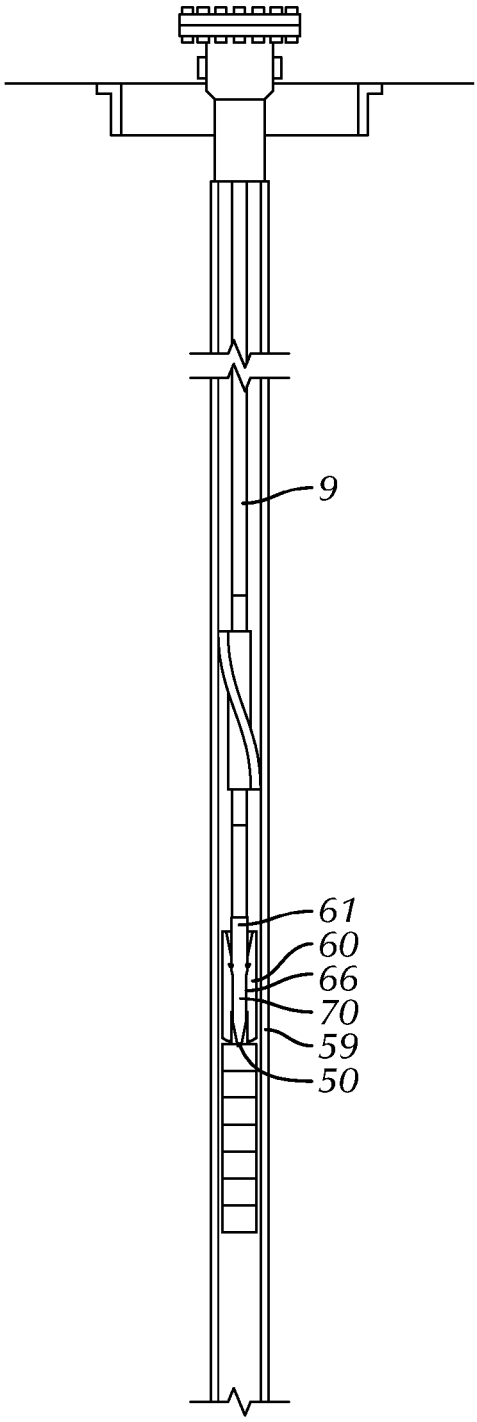

Embodiments of the downhole latching mechanism are illustrated, by way of example only, in FIGS. 7-9. As illustrated in FIGS. 7A-7B, a downhole latching mechanism 59 connects a rod string 9 to a downhole pump 49. The downhole pump 49 can be any type, including but not limited to a PCP, or other submersible pump, such as a multistage centrifugal downhole pump. The downhole latching mechanism 59 primarily comprises two segments—a female segment 60 and a male segment 61.

Referring to FIG. 7A, by way of example only, the female segment 60 connects to the bottom 50 of the rod string 9, and the male segment 61 connects to the upper end 57 of the downhole pump 49. However, this is merely one embodiment, and alternative configurations are possible. For example, in an alternative embodiment, illustrated by way of example in FIG. 7B, the male segment 61 connects to the bottom 50 of the rod string 9, and the female segment 60 connects to the upper end 57 of the downhole pump 49.

Figure 8A:
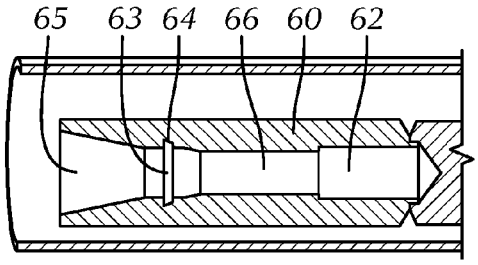
FIGS. 8A-8B illustrate cross sectional views of segments of a downhole latching mechanism.

Referring to FIG. 8A, the female segment 60 comprises a hollow barrel 62, a shear spring 63, and a spring attachment groove 64. The hollow barrel 62 has a tapered/conical receiving end 65, and is designed to guide, center and receive the male segment 61. The hollow barrel 62 further comprises an engaging section 66, which is designed to engage with a corresponding section of the male segment 61. Engaging section 66 can have any design, including but not limited to a splined, square, hexagonal, or octagonal section, so long as its faces are able to lock with the male segment's 61 engaging section during rotation. By way of example only, FIG. 8A depicts a female segment 60 having a hexagonal engaging section 66.

The spring attachment groove 64 is positioned near the tapered/conical receiving end 65 of the hollow barrel 62. The spring attachment groove 64 is designed to secure the shear spring 63 to the female segment 60. In one embodiment, the shear spring 63 is a shearable canted coil spring. In another embodiment, the spring attachment groove 64 is designed within a very narrow tolerance. The shear spring 63 can be manually inserted into the spring attachment groove 64 at the well surface. It is designed to receive the male segment 61 at a low insertion force, and withstand tension up to a certain predetermined shearing force. For example, shear spring 63 can be designed to shear at any preferred shearing force. In one embodiment, the shear spring 63 is designed to shear at a force as high as 25,000 lbs. In another embodiment, the shear spring 63 is designed to shear at a force as low as 4,000 lbs.

Figure 8B:
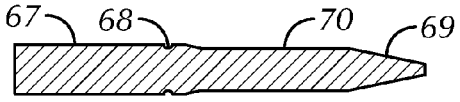

Referring to FIG. 8B, the male segment 61 primarily comprises a shaft 67, a spring locking groove 68, and a tip 69. The male segment's 61 shape is symmetrical to the female segment's 60 hollow barrel 62 so that the male segment 61 can mate and lock with the female segment 60. The tip 69 is tapered or conical so that the male segment can be smoothly guided into the female segment's 60 hollow barrel 62 during latching. The shaft 67 further comprises an engaging section 70, which is designed to engage with the female section's 60 engaging section 66. Again, engaging section 70 can have any design, including but not limited to a splined, square, hexagonal, or octagonal section, so long as its faces are designed to interact with the female segment's 60 engaging section 66 during rotation. By way of example only, FIG. 8B depicts a male segment 61 having a hexagonal engaging section 70.

The spring locking groove 68 is designed and positioned to align and engage with the shear spring 63 during latching. It is designed to secure the male segment 61 to the female segment 60 and withstand forces up to the shearing force of the shear spring 63. Thus, the downhole latching mechanism 59 is maintained even if the rod string 9 is pulled in tension. But if a shearing force is applied, the shear spring 63 breaks disengaging the male segment 61 from the female segment 60.

Figure 9A:
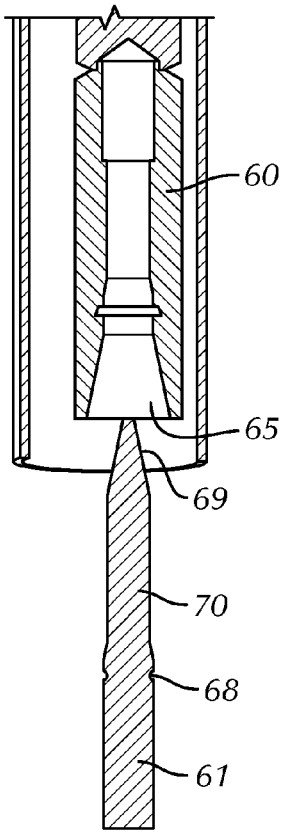
FIGS. 9A-9C illustrate latching a downhole latching mechanism.
Figure 9B:
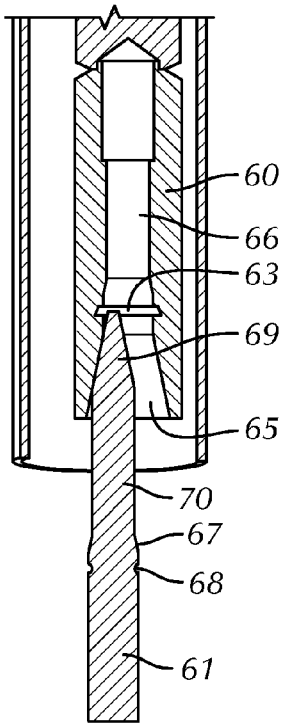
Figure 9C:
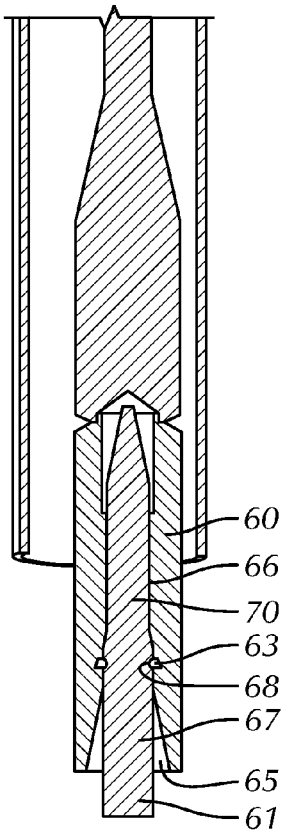

FIGS. 9A-9C illustrate embodiments of the latching process. Referring to FIG. 9A, the male segment 61 is inserted into the female segment's 60 tapered/conical receiving end 65. In FIG. 9B, as the male segment and 61 and female segment 60 engage, the tapered/conical tip 69 interacts with the walls of the tapered/conical receiving end 65 of the hollow barrel 62. This tapered/conical design guides and centers the male segment 61 into the hollow barrel 62 during latching. As the segments engage, the shaft 67 passes through the shear spring 63 and into the female segment's engaging section 66.

Finally, in FIG. 9C, the male segment 61 and female segment 60 are latched when the shear spring 63 slides into the male segment's 61 spring locking groove 68. When latched, the segments' engaging sections 66, 70 are positioned to interact during rotation.

In one embodiment, a downhole pump 49 is activated by rotation of the downhole latching mechanism 59. Referring to FIG. 7A, by way of example only, the rod string 9 is rotated to transfer rotational power from the bottom 50 of the rod string 9 to the female segment 60. As the female segment 60 rotates, the faces of the engaging sections 66, 70 interact and generate friction, thereby transferring rotational power from the female segment 60 to the male segment 61. Finally, the male segment 61 is connected to the downhole pump's 49 bearing assembly. As the male segment 61 is rotated, rotational power is transferred to the bearing assembly to drive the downhole pump 49.

Referring to FIG. 7B, by way of example only, the rod string 9 is rotated to transfer rotational power from the bottom 50 of the rod string 9 to the male segment 61. As the male segment 61 rotates, the faces of the engaging sections 66, 70 interact and generate friction, thereby transferring rotational power from the male segment 61 to the female segment 60. Finally, the female segment 60 is connected to the downhole pump's 49 bearing assembly. As the female segment 60 is rotated, rotational power is transferred to the bearing assembly to drive the downhole pump 49.

In another embodiment, the rod string 9 is disengaged from the downhole pump 49 by applying a force to the rod string 9 at or above the shear force of the shear spring 63. This shear force causes the shear spring 63 to break, disengaging the female segment 60 from the male segment 61. This design provides for easy and inexpensive rod engaging and disengaging of the rod string 9 with the downhole pump 49 both at the surface and downhole. Furthermore, after disengagement, the shear spring 63 is readily replaceable by an operator at the surface.

In an alternative embodiment, in lieu of a shear spring 63, the female segment 60 instead comprises a J-slot for receiving a shear pin after engaging the female segment 60 with the male segment 61. In yet another embodiment, the female segment 60 and male segment 61 are connected via a shear screw. In still another embodiment, the female segment 60 and male segment 61 are connected via a press fit. The shear pin, shear screw, and press fit can also be designed to break at a preferred shear force.

In one embodiment, the interaction between the engaging sections 66, 70 is capable of withstanding over 700 ft-lbs of torque.

In yet another embodiment, the downhole latching mechanism 59 comprises a tag bar assembly to prevent the rod string from being installed too far during latching, and to hold the entire weight of the rod string without damaging the downhole pump 49. Furthermore, in another embodiment, the downhole latching mechanism 59 comprises a thrust bearing assembly to withstand the rod string tension and to prevent the tension from transferring to the downhole pump 49.

It is to be understood that the above description is intended to be illustrative, and not restrictive. The material has been presented to enable any person skilled in the art to make and use the inventive concepts described herein, and is provided in the context of particular embodiments, variations of which will be readily apparent to those skilled in the art (e.g., some of the disclosed embodiments may be used in combination with each other). Many other embodiments will be apparent to those of skill in the art upon reviewing the above description. The scope of the invention therefore should be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A surface drivehead for rotating a rod string extending down a well, comprising:

a motor support supporting a drivehead motor;

a polished rod extending through the motor support and engaged with the drivehead motor; and an axial bearing assembly connected to the polished rod and engaged with one or more linear actuators, wherein the one or more linear actuators are configured to displace the rod string along its longitudinal axis by moving the polished rod along an axis; and wherein the drivehead activates the drivehead motor to rotate the rod string, monitors rod string tension during the rod string rotation, and activates the one or more linear actuators to maintain a substantially constant tension on the rod string.

2. The surface drivehead of claim 1, wherein the polished rod is coupled to the upper end of the rod string.

3. The surface drivehead of claim 2, wherein the drivehead motor is capable of rotating the polished rod and the rod string about the axis.

4. The surface drivehead of claim 1, wherein the drivehead motor is an electric or hydraulic motor.

5. The surface drivehead of claim 1, wherein the polished rod is moved along the axis either into the well to decrease tension in the rod string, or out of the well to increase tension in the rod string.

6. The surface drivehead of claim 1, wherein the polished rod is automatically moved in response to a gain or a loss in the monitored rod string tension.

7. The surface drivehead of claim 1, wherein the rod string is rotated between approximately 0-3600 rpms.

8. The surface drivehead of claim 1, wherein the bottom of the rod string is connected to a downhole pump.

9. The surface drivehead of claim 1, wherein the one or more linear actuators comprise one or more mechanical springs.

10. The surface drivehead of claim 1, wherein the one or more linear actuators comprise one or more hydraulic cylinders.

11. The surface drivehead of claim 1, wherein the one or more linear actuators comprise one or more ball screws.

12. The surface drivehead of claim 1, wherein the one or more linear actuators comprise one or more crane systems.

13. The surface drivehead of claim 1, wherein the one or more linear actuators are engaged with the polished rod via the axial bearing assembly, and wherein the polished rod is engaged with the axial bearing assembly by a clamp.

14. The surface drivehead of claim 13, wherein the one or more linear actuators move the axial bearing assembly and the clamp to move the polished rod and the top end of the rod string along the axis.

15. A rod-driven pumping system, comprising:

a surface drivehead positioned at surface;

a rod string connected to the surface drivehead and extending downhole through a bore of a production tubing; and a downhole pump connected downhole to the bottom of the rod string, wherein the surface drivehead is capable of driving the downhole pump by rotating the rod string at the surface;

wherein the surface drivehead comprises an axial bearing assembly connected to the rod string and engaged with one or more linear actuators, wherein the one or more actuators are configured to displace the rod string along its longitudinal axis, and wherein the drivehead monitors rod string tension during the rod string rotation and activates the one or more linear actuators to maintain a substantially constant tension on the rod string.

16. The rod-driven pumping system of claim 15, wherein the downhole pump is a progressive cavity pump, or a multistage centrifugal pump.

17. The rod-driven pumping system of claim 15, wherein the bottom of the rod string is connected to the downhole pump via a downhole latching mechanism.

18. The rod-driven pumping system of claim 17, wherein the downhole latching mechanism comprises a male segment insertable into a female segment.

19. The rod-driven pumping system of claim 18, wherein the male segment is secured to the female segment by one or more of a shear spring, shear pin, shear screw.

20. The rod-driven pumping system of claim 15, wherein the surface drivehead is capable of moving the rod string along the longitudinal axis either out of the well to increase tension in the rod string, or in to the well to decrease tension in the rod string.

21. The rod-driven pumping system of claim 15, wherein the surface drivehead comprises:

a polished rod connected to the upper end of the rod string;

wherein the axial bearing assembly is connected to the polished rod and is engaged with the one or more linear actuators configured to displace the rod string along its longitudinal axis, wherein the one or more linear actuators are capable of moving the polished rod along an axis; and wherein the polished rod and the rod string are rotated about the axis by a drivehead motor.

22. The rod-driven pumping system of claim 15, wherein the one or more linear actuators comprise one or more hydraulic cylinders.

23. The rod-driven pumping system of claim 15, wherein the surface drivehead is capable of rotating the rod string between approximately 0-3600 rpms.

24. A method of driving a downhole pump from a surface at high speeds, comprising:

activating a surface drivehead positioned at the surface to rotate the rod string connected to the downhole pump, wherein the surface drivehead comprises a polished rod for moving a top end of the rod string upwards and downwards along an axis;

activating the surface drivehead to move the top end of the rod string along the axis to achieve a predetermined rod string tension;

monitoring the rod string tension during the rod string rotation; and maintaining the rod string at a substantially constant rod string tension.

25. The method of claim 24, wherein the surface drivehead moves the top end of the rod string along the axis by moving the polished rod with one or more linear actuators configured to displace the rod string along its longitudinal axis.

26. The method of claim 25, wherein the linear actuators move the polished rod by moving an axial bearing assembly, wherein the axial bearing assembly is engaged with the polished rod by a clamp.

27. The method of claim 25, wherein the one or more linear actuators comprise one or more hydraulic cylinders.

28. The method of claim 24, wherein the rod string tension is monitored by a load cell connected to the surface drivehead.

29. The method of claim 24, wherein maintaining the rod string at the substantially constant tension further comprises moving the polished rod upwards along the axis to increase tension in the rod string.

30. The method of claim 24, wherein maintaining the rod string at the substantially constant tension further comprises moving the polished rod downwards along the axis to decrease tension in the rod string.

31. The method of claim 25, wherein the polished rod is automatically moved by the one or more linear actuators to compensate for a rod string tension.

32. The method of claim 25, wherein the polished rod is automatically moved by the one or more linear actuators to compensate for a rod string tension gain.

33. The method of claim 24, further comprising rotating the rod string at speeds between approximately 0-3600 rpms.

* * * * *